US006969141B2

(12) United States Patent
Horiuchi et al.

(10) Patent No.: US 6,969,141 B2
(45) Date of Patent: Nov. 29, 2005

(54) INK JET RECORDING APPARATUS AND INK JET RECORDING METHOD

(75) Inventors: Akinori Horiuchi, Kanagawa (JP); Nobutsune Kobayashi, Kanagawa (JP); Tsuyoshi Otani, Kanagawa (JP); Hiroyuki Saito, Kanagawa (JP); Akira Okamoto, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 229 days.

(21) Appl. No.: 10/648,868

(22) Filed: Aug. 27, 2003

(65) Prior Publication Data

US 2004/0041869 A1 Mar. 4, 2004

(30) Foreign Application Priority Data

Aug. 28, 2002 (JP) ..... 2002-249703

(51) Int. Cl.[7] ..... B41J 29/393; B65H 5/22
(52) U.S. Cl. ..... 347/19; 347/105; 271/3.17
(58) Field of Search ..... 347/16, 19, 104, 347/105; 400/592, 596, 600.3, 624, 642; 271/3.17, 9.01, 153

(56) References Cited

U.S. PATENT DOCUMENTS 5,488,407 A * 1/1996 Tachibana ..... 347/264
6,126,160 A * 10/2000 Ebert et al. ..... 271/10.03

* cited by examiner

*Primary Examiner*—Lamson Nguyen
(74) *Attorney, Agent, or Firm*—Morgan & Finnegan, LLP

(57) ABSTRACT

In the ink jet recording apparatus, while the formation of an image on the present sheet is in progress, the remaining length-to-rear end Le between the point at which the presence of the sheet is detected by the sheet detection sensor to the rear end of the present sheet and the remaining recording time Tr from the present time point to the time point at which the formation of the image on the present sheet is completed are measured. Further, in the apparatus, the sheet for the next page is supplied from the feed sheet unit when it is found that that the formation of the image on the sheet for the next page is necessary, that the remaining length-to-rear end Le is less than the reference remaining length-to-rear end Lr, and that the remaining recording time Tr is less than the reference remaining recording time TrR.

6 Claims, 4 Drawing Sheets

INK JET RECORDING APPARATUS AND INK JET RECORDING METHOD

This application claims priority from Japanese Patent Application No. 2002-249703 filed Aug. 28, 2002, which is incorporated hereinto by reference.

BACKGROUND OF THE INVENTION

1. Field of the Invention

The present invention relates to an ink jet recording apparatus and an ink jet recording method.

2. Description of the Related Art

Conventionally, ink jet recording apparatuses have been widely used in various purposes. In general, an ink jet printing apparatus is designed for performing the continuous printing operation for a plurality of recording medium mostly by repeating the steps (1) through (4) as described in the following.

(1) A step for issuing the command for requiring the feed of paper sheet or recording medium.

(2) A step for issuing the command for requiring the feed of the recording medium to the recording medium feed unit and the command for requiring the recording operation to the recording head, which are to be repeated alternately for the formation of the image on the present recording medium (the recording medium whereon the image is currently being formed).

(3) A step for issuing the command for requiring the ejection of the present recorded recording medium after confirming that the recording on the present recording medium has been completed.

(4) A step for issuing the command for permitting the supply of the sheet for the next page after completing the ejection of the recorded recording medium or while the ejection of the recorded recording medium is in progress.

As described in connection with the above step (4), at present, it has become a common practice to issue the command for the feed of the next sheet while the ejection of the present recorded recording medium is in progress, not after completing the ejection of the present recorded recording medium, aiming at the improvement of the throughput.

In recent years, however, as the demand for the large-capacity feed sheet unit of the ink jet recording apparatus increases, it has become inevitable to increase the length of the transfer path ranging from the feed sheet tray to the recording head. This naturally results in the increase in the time required for each recording medium supplied from the feed sheet tray to reach the recording point even if the command for the supply of the recording medium for the next page is issued while the ejection of the recorded recording medium is in progress, and so it has been hard to improve the throughput as desired. On the other hand, merely speeding the issuance of the command for the supply of the sheet for the next page can result in the trouble such as the jamming of the recording media.

SUMMARY OF THE INVENTION

In consideration of what has been discussed above, an object of the present invention is to provide an ink jet recording apparatus and an ink jet recording method, capable of contributing to the substantial improvement in the throughput thereof, by enabling the supply of the recording medium for the next page to be started as soon as possible without inviting the trouble such as the jamming of the recording medium.

To achieve this objective, the present invention provides an ink jet recording apparatus for forming an image on a recording medium supplied from a feed sheet unit and transferred in a predetermined transfer direction by jetting ink from a recording head made to move in the main scanning direction thereof, the apparatus comprising: a recording medium detection unit for detecting a first recording medium whereon formation of an image is in progress, provided on an upstream side of the recording head in the transfer direction; a remaining length-to-rear end measuring unit for measuring length from a point at which presence of the first recording medium is detected by the recording medium detection unit to a rear end of the first recording medium; a remaining recording time measuring unit for measuring time from the point until the formation of the image on the first recording medium is completed; and a control unit for letting the feed sheet unit start a feed of a second recording medium when the length measured by the remaining length-to-rear end measuring unit is found to be less than predetermined reference length, and the time measured by the remaining recording time measuring unit is found to be less than predetermined reference time.

Further, the ink jet recording apparatus further comprises a next page recording determining unit for determining whether formation of an image on the second recording medium is necessary or not when the second recording medium for the next page is supplied from the feed sheet unit following the first recording medium, wherein the control unit operates for letting the feed of the second recording medium start when it is found that the image needs to be formed on the second recording medium by the next page recoding determining unit.

Further, the predetermined reference time is time from a point at which a feed of a sheet is started by the feed sheet unit until the second recording medium starts to move.

In present recording apparatus, while the recording of the image on the first recording medium for the present page is in progress, not only the length between the point at which the present recording medium is detected and the rear end of the first recording medium is measured by the remaining length-to-rear end measuring means but also the time between the present point and the point at which the formation of the image on the first recording medium has been completed is measured by the remaining recording time measuring means. Further, in the present recording apparatus, where it is found that there is the need to form the image on the second recording medium for the next page by the image-formation-need finding means, the feed paper unit starts the release of the sheet for the second recording medium when the length measured by the remaining length-to-rear end measuring means is shorter than the predetermined reference length, and the time measured by the remaining time measuring means is shorter than the predetermined reference time.

In this way, where it is assured that the first recording medium and the second recording medium will not overlap with each other, it becomes possible to start the release of the sheet as being the second recording medium while the formation of the image on the first recording medium is in progress. Thus, according to the present ink jet recording apparatus, it is possible to set the time for starting the release of the second recording medium quite properly and earlier when it is necessary to form the image on the second recording medium for the next page, thereby easily contributing to the improvement in the throughput.

Further, to achieve the above objective, the present invention provides an ink jet recording method for forming an image on a recording medium supplied from a feed sheet unit and transferred in a predetermined transfer direction by jetting ink from a recording head made to move in the main scanning direction thereof, the method comprising the steps of: (a) detecting a first recording medium whereon formation of an image is in progress on an upstream side of the recording head in the transfer direction; (b) measuring length from a point at which presence of the first recording medium is detected in the step (a) to a rear end of the first recording medium; (c) measuring time from the point until the formation of the image on the first recording medium is completed; and (d) letting the feed sheet unit start a feed of the second recording medium when the length measured in the step (b) is found to be less than predetermined reference length, and the time measured in the step (c) is found to be less than predetermined reference time.

Further, the step (d) comprises determining whether or not an image needs to be formed on the second recording medium for the next page to be supplied from the feed sheet unit following the first recording medium so that the feed of the second recording medium can be started when it is found that the image needs to be formed on the second recording medium.

Further, to achieve the above objective, the present invention provides 6. a computer program product for executing an ink jet recording method for forming an image on a recording medium supplied from a feed sheet unit and transferred in a predetermined transfer direction by jetting ink from a recording head made to move in the main scanning direction thereof, the computer program product comprising: (a) first program code means for detecting a first recording medium whereon formation of an image is in progress on an upstream side of the recording head in the transfer direction; (b) second program code means for measuring length from a point at which presence of the first recording medium is detected in the step (a) to a rear end of the first recording medium; (c) third program code means for measuring time from the point until the formation of the image on the first recording medium is completed; and (d) fourth program code means for letting the feed sheet unit start a feed of the second recording medium when the length measured in the second program code means (b) is found to be less than predetermined reference length, and the time measured in the third program code means (c) is found to be less than predetermined reference time.

Further, the fourth program code means (d) comprises determining whether or not an image needs to be formed on the second recording medium for the next page to be supplied from the feed sheet unit following the first recording medium so that the feed of the second recording medium can be started when it is found that the image needs to be formed on the second recording medium.

As described in the foregoing, according to the present invention, when there is the need of forming the image on the recording medium for the next page, the command for permitting the supply of the recording medium for next page can be issued earlier while the formation of the image on the present recording medium is in progress without causing the trouble such as the jamming of the recording medium sheets.

The above and other objects, effects, features and advantages of the present invention will become more apparent from the following description of embodiments thereof taken in conjunction with the accompanying drawings.

DETAILED DESCRIPTION OF PREFERRED EMBODIMENTS

The preferred embodiments of the present invention will be described in detail with referring to the accompanying drawings.

Figure 1:
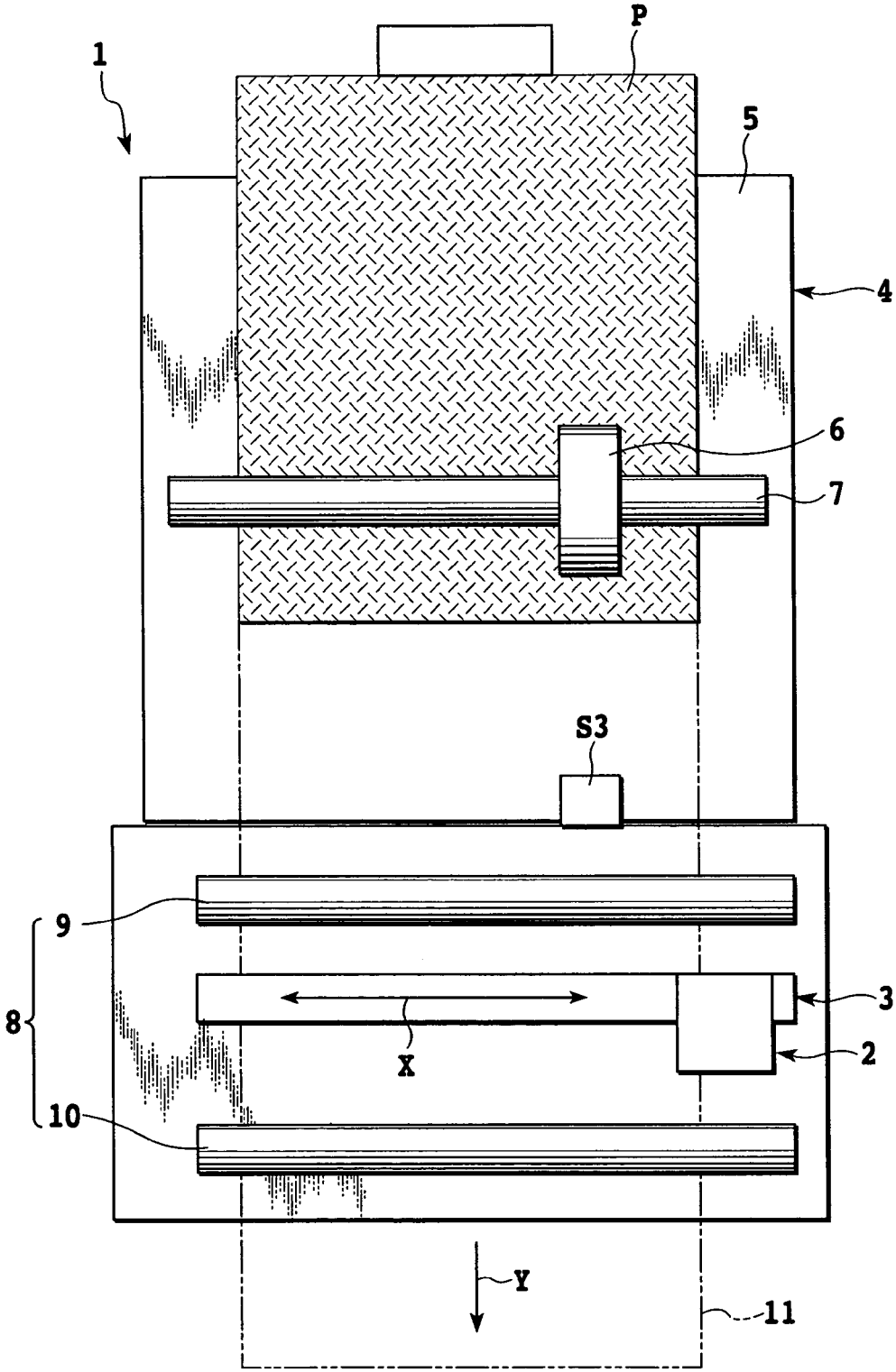
FIG. 1 is a diagram schematically illustrating the composition of the ink jet recording apparatus according to the present invention.

FIG. 1 is a diagram schematically illustrating the composition of the ink jet recording apparatus according to the present invention. An ink jet recording apparatus 1 illustrated in the diagram comprises a recording head 2 capable of jetting the ink. The recording head 2 is mounted on a carriage (not shown), and the carriage is designed for being capable of making the scanning motion in the main scanning direction extending in the direction of X shown in FIG. 1 by means of a carriage drive mechanism 3 comprising a carriage motor CRM 27 (Refer to FIG. 2).

The recording head 2 is designed as what is called an ink jet head, and is provided with an electrothermal converter for converting the electrical energy into the thermal energy. In the recording head 2, the heat generated from the electrothermal converter causes the boiling of the ink film, and resulting change in the ink pressure owing to the expansion and the shrinkage of the air bubbles is used to jet the ink from each nozzle. The eletrothermal converter is provided for each nozzle, and the pulse voltage is applied to each electrothermal converter for jetting the ink.

A carriage drive mechanism 3 comprises a code strip for detecting the position of the carriage mounted with the recording head 2 and an encoder sensor. The code strip is provided by being extended in parallel to the timing belt for the drive of the carriage and has the marking placed thereon, for example, at the pitch of 150–300 lpi. The marking on the code strip is read by an encoder sensor installed on the carriage substrate mounted on the carriage. The code strip and the encoder sensor function as a CR displacement sensor S1 for detecting the movement of the carriage (recording head 2) along a printing line of letters or characters.

Further, the ink jet recording apparatus 1 is provided with a feed sheet unit 4 (automatic sheet feeder). The feed sheet unit 4 comprises a feed sheet tray 5, a pickup roller 6 or the like. The pickup roller 6 is mounted on a rotary shaft 7, while a rotary shaft 7 receives the drive force of a feed sheet motor ASFM 28. The feed sheet P as the recording medium loaded on the feed sheet tray 5 is supplied one by one by means of the pickup roller 6. Further, the feed sheet P loaded on the feed sheets tray 5 is sent to a positioning member (not shown) to be positioned.

Further, the ink jet recording apparatus 1 is provided with a feed sheet transfer unit 8. The feed sheet transfer unit 8 comprises a first transfer roller 9, provided on the upstream side (on the side of a feed sheet unit 4) of the recording head 2 and the carriage drive mechanism 3, and a second transfer roller 10 provided on the downstream side of the recording head 2 and the carriage drive mechanism 3. The first transfer roller 9 and the second transfer roller 10 are driven by a transfer motor LFM29. Further, a platen (not shown) for setting the position of the feed sheet P for the image forming operation is provided under the recording head 2.

The first transfer roller 9 is provided with a code wheel (not shown) for detecting the quantity of the transferred feed sheets. The code wheel has the marking placed thereon at a pitch of 150–300 lpi and is read by the encoder sensor provided in the vicinity of the code wheel. The code wheel and the encoder sensor cooperate to function as a sheet conveyance amount sensor S2 for detecting the amount of a feed sheet P conveyance.

The feed sheet P sent out from the feed sheet unit 4 is transferred towards the recording point of the recording head 2 by the first transfer roller 9. Then, while the feed sheet P is transferred on a transfer path 11, extending in the direction of Y shown in FIG. 1 (i.e., sub-scanning direction or transfer direction), the recording head 2 moves in the scanning direction (the direction of X) to jet the ink against the feed sheet P, thereby forming a desired image on feed sheet P. The sheet P with an image formed thereon is sent out to the sheet ejection unit (not shown) by the second transfer roller 10 to be ejected onto an ejected sheet tray of a sheet ejection unit.

Further, the ink jet recording apparatus 1 comprises a feed sheet detection sensor S3. The feed sheet detection sensor S3 is provided on the upstream side of the recording head 2 (and he first transfer roller 9) in the feed sheet transfer direction (the direction of Y). The feed sheet detection sensor S3 outputs a feed sheet detection signal when the front end of the feed sheet P sent out from the feed sheet unit 4 is detected.

Figure 2:
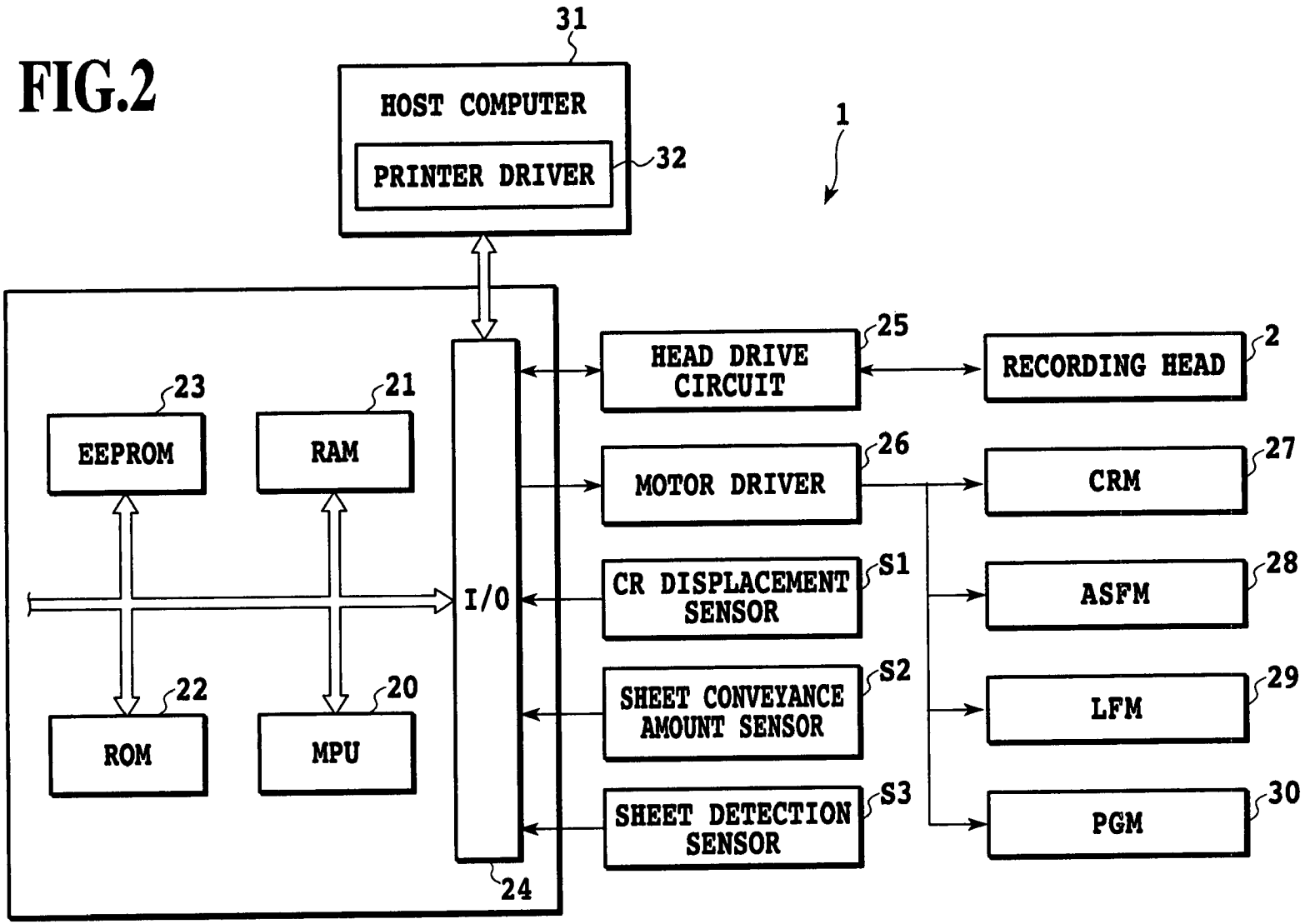
FIG. 2 is a block diagram illustrating the process of control of the ink jet recording apparatus shown in FIG. 1.

FIG. 2 is a block diagram illustrating the control system of the ink jet recording apparatus. As shown in the figure, the ink jet recording apparatus 1 comprises an MPU 20 as a control means having the function to control the whole apparatus. The MPU 20 is connected with RAM 21, ROM 22 and EEPROM 23 through a bus line. The RAM 21 comprises a reception buffer for temporarily storing various data, a print buffer and a work area for use as an area for the processing of the data relating to various control operations. Further, the ROM 22 stores various control programs or the like, whereas the EEPROM 23 stores various sets of information relating to the ink jet recording apparatus 1. These sets of information comprises the information concerning the automatic ON/OFF of power source, the information concerning the settings of the printer including the settings of the functional items such as the dry mode or the like, the information concerning the recording medium (feed sheet P) such as full length, number of sheets used for recording, the remainder of the ink; reference remaining length-to-rear end L r., reference remaining time TrR, which are described later in detail; or the like.

Further, the MPU 20 is connected with an input/output interface 24 through a bus line. The input/output interface 24 enables the 2-way communications among various apparatuses including host computer 31 or the like through the interfaces such as the IEEE1284, IEEE1394, USB, wireless LAN or the like. In the case of the present embodiment, the input/output interface 24 is connected with the external host computer 31 with printer driver 32 installed therein. Further, the recording head 2 is connected with the input/output interface 24 through the head drive circuit 25 and controlled by the MPU 20.

Similarly, a carriage motor CRM 27 of the carriage drive mechanism 3, a feed sheet motor ASFM 28 of the feed sheet unit 4, a transfer motor LFM 29 of the feed sheet unit 8, a purge motor PGM30 for driving the recovery device of the recording head 2 and the like are connected with the input/output interface 24 through a motor driver 26. Motors CRM 27, ASFM 28, LFM 29 and PGM 30 are controlled independently from one another by motor driver 26. Further, a CR displacement sensor S1, a sheet conveyance amount sensor S2, a feed sheet detection sensor S3 or the like and other switches are also connected with the input/output interface 24.

Figure 3:
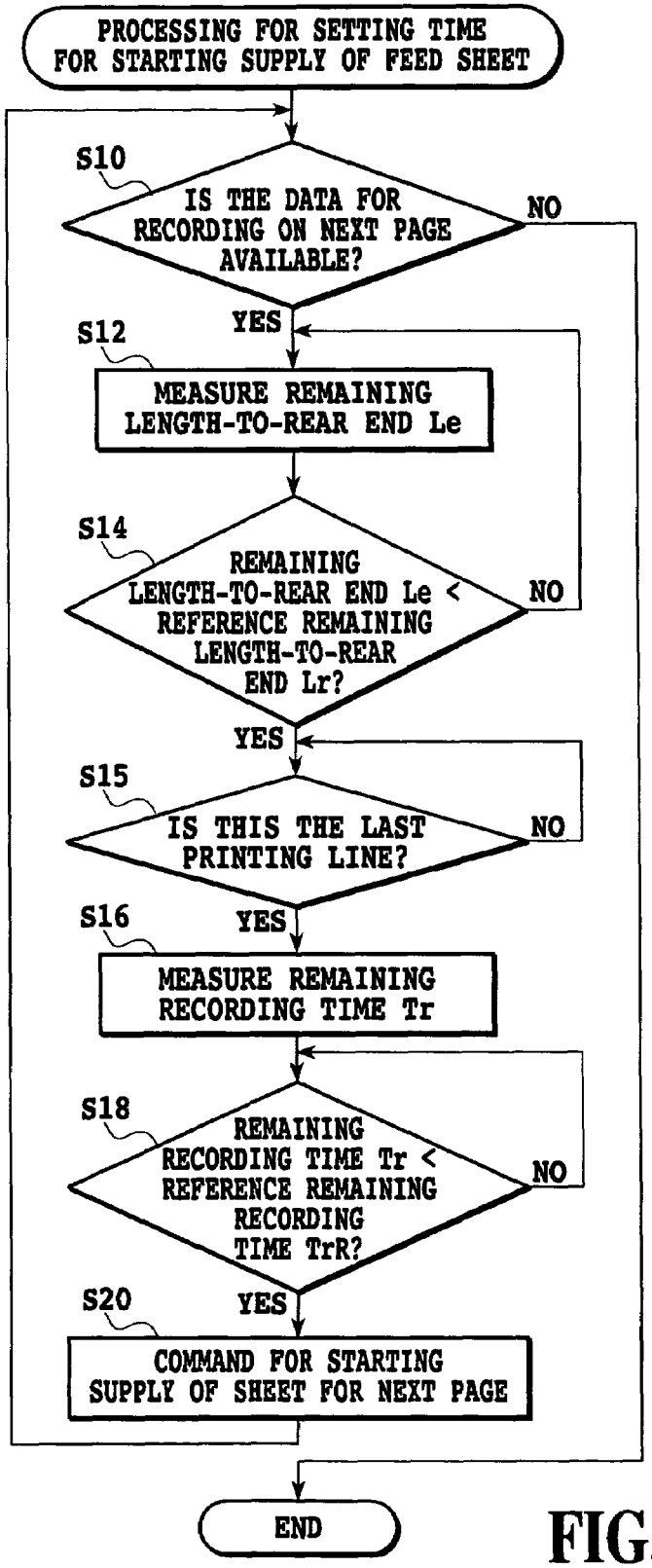
FIG. 3 is a flowchart illustrating the process for determining the time at which the supply of the feed sheet is to be started in the ink jet recording apparatus shown in FIG. 1.
Figure 4:
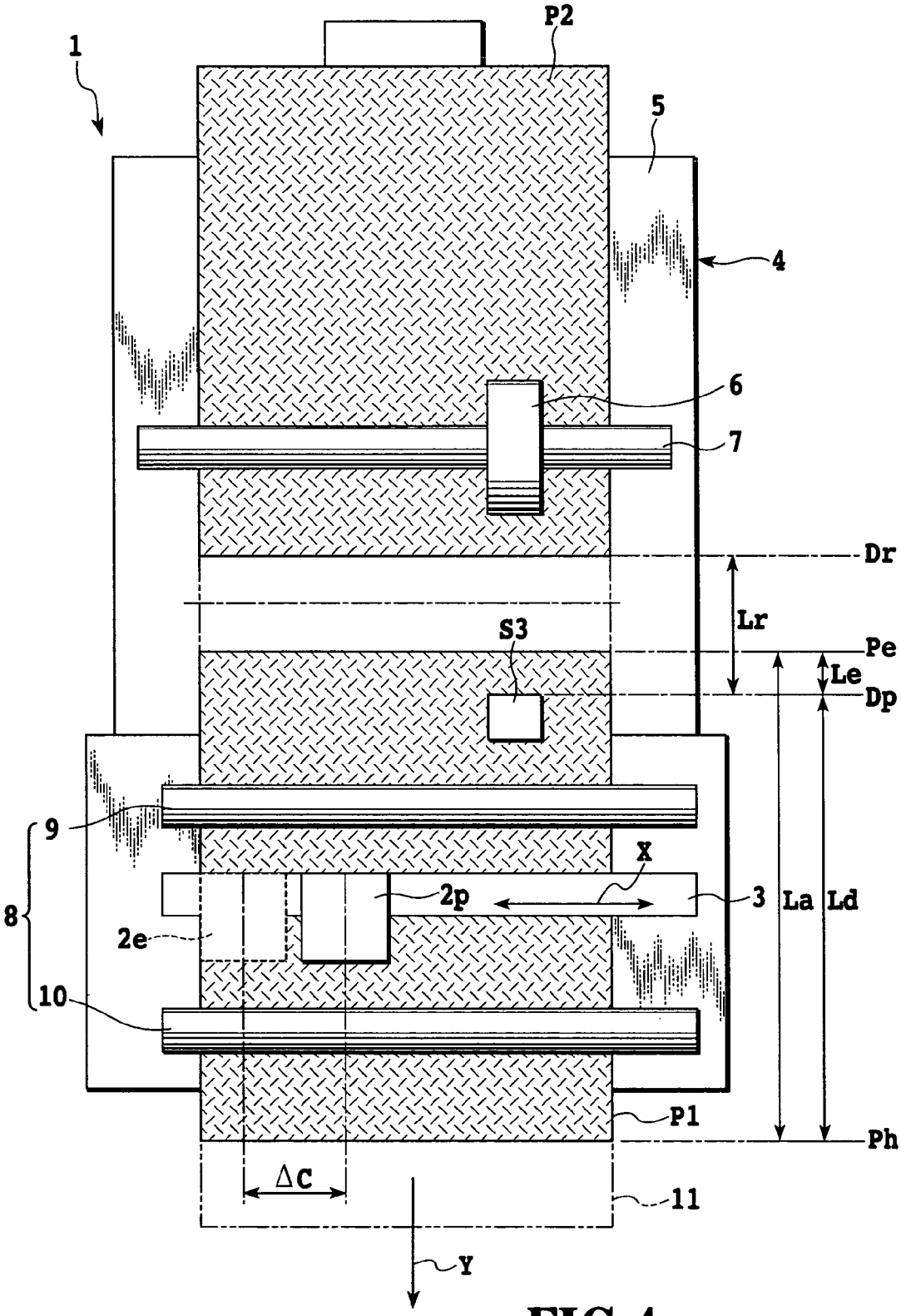
FIG. 4 is a schematic diagram illustrating the process for setting the time at which the supply of the feed sheet is to be started in the ink jet recording apparatus shown in FIG. 1.

Next, the processing for determining the time to feed the sheet in the ink jet recording apparatus 1 will be described with referring to FIGS. 3 and 4. FIG. 3 illustrates the content of the processing by the control program to be executed by the MPU 20. The MPU 20 reads out and executes the control program stored in the ROM 22. The processing for determining the time for starting the feed of the sheet is executed in parallel with the recording operation of the recording head 2 starting at the predetermined time. In this case, when the feed of the sheet by the feed sheet unit 4 and the subsequent recording operation of the recording head 2 have been started, at a predetermined timing, the MPU 20 of the ink jet recording apparatus 1 checks whether the data to be recorded on the sheet P2 for the next page, which is to be fed from the feed sheet unit 4 following the present sheet P1 that is a recording medium whereon formation of an image is in progress (under supply or conveyance), is available or not in order to determine whether the image is to be formed on the sheet P2 (i.e., the sheet P2 currently on the feed sheet tray 5) for the next page (Step 10) or not.

In the processing of the Step 10, the MPU 20 determines whether the recording on the next sheet is necessary or not, on the basis of the signal for indicating the presence or absence of the data to be recorded on the sheet for the next page from the printer driver 32 of the host computer 31 or on the basis of the recording data from the host computer 31. In the Step 10, when it is found that the data for the recording on the next page is not present, the processing for setting the time for the feed of sheet will not be executed.

On the other hand, when it is found that the data for the recording on the next page is present in Step 10, the remaining length-to-rear end Le of the present sheet P1 is measured in Step 12. In this case, the remaining length-to-rear end Le of the sheet is the partial length of the present sheet P1 measured from the point Dp at which the sheet is detected by the sheet detection sensor S3 to the rear end Pe thereof. The remaining length-to-rear end Le of the sheet can be obtained by subtracting the amount of transfer Ld of the sheet P1 by the sheet transfer unit 8 between the point at which the front end Ph of the present sheet P1 is detected by the sheet detection sensor 3 and the present point from the full length La of the sheet P1 (measured in the direction of transfer).

In this case, the amount of transfer Ld of the present sheet P1 from the point at which the front end Ph thereof is detected by the sheet detection sensor S3 to the present point can be detected by the sheet conveyance amount sensor S2 (the code wheel and encoder sensor). The MPU 20 reads out the full length La of the present sheet P1 stored in the EEPROM 23 and measures the remaining length-to-rear end Le based on full length La of present sheet P1, which has been read out previously, and the amount of transfer Ld detected by the sheet conveyance amount sensor S2.

When the remaining length-to-rear end Le of the present sheet P1 is measured in the Step 12, the MPU 20 compares the remaining length-to-rear end Le with the predetermined reference remaining length-to-rear end Lr to determine whether or not the remaining length-to-rear end Le is less than the reference remaining length-to-rear end Lr (i.e., remaining length-to-rear end Le<reference remaining length-to-rear end Lr) (Step 14). Here, the reference remaining length-to-rear end Lr is the length from the detection point Dp by the sheet detection sensor S3 to the reference point Dr set on the upstream side of the sheet detection sensor S3 in the direction of the sheet transfer. In order for the throughput to be improved, it is desired not only that the front end positions of the sheets P is mechanically uniform when loaded on the feed sheet tray (ASF) 5 but also that the position of the present sheet P1 is as close as possible to the position of the next sheet P2, and thus the reference point Dr may be made to coincide with the front end of sheet P (or the sheet P2 for the next page) or the point coinciding with the position of the positioning member of the feed sheet tray 5. The MPU 20 repeats the processes of the Step 12 and the Step 14 until it is found that the remaining length-to-rear end Le is less than the reference remaining length-to-rear end Lr in the Step 14.

When it is found, in the Step 14, that the remaining length-to-rear end Le is less than the reference remaining length-to-rear end Lr, the MPU 20 determines, in the Step 15, whether or not the present position 2*p* (FIG. 4) of the recording head 2 is within the last printing line. More specifically, the MPU 20 executes one or more commands, which has or have been sent from the printer driver 32 of the host computer 31 and stored in the buffer of the RAM 21, and checks, in the Step 15, the command next to the printing command that is currently executed. The MPU 20 determines, in the Step 15, that the present position 2*p* of the recording head 2 is within the last printing line when the next command is found to be the sheet ejection command.

In the Step S15, when it is found that the present position 2*p* is within the last printing line, the MPU 20 measures, in the Step 16, the remaining recording time Tr ranging from the present time point to the time point at which the formation of the image on the present sheet P1 completes. In this process, the remaining recording time Tr corresponds to the length of the time required for the recording head 2 to travel the distance (i.e., the distance ΔC) from the present position 2*p* (FIG. 4) within the last printing line to the position 2*c* (FIG. 4) within the last printing line at the recording completion on the present sheet P1.

The remaining time Tr can be obtained by $$Tr=\Delta C/Vc=(Ca-Cp)/Vc,$$

where Cp=Distance of travel of the carriage (recording head 2) from the start of recording within the last printing line to the present position 2*p*, which can be obtained by the CR travel distance sensor S1;

Ca=Total distance of travel by the carriage (recording head 2) from the start of recording on the present sheet P1 in the last printing line to the point 2*e* at which the recording is finished;

Vc=Travel speed of the carriage (recording head 2).

This formula is commonly applicable to both the carriage (recording head 2) designed for two-way printing and the carriage designed for one-way printing.

When the remaining recording time Tr for the present sheet P1 is-measured in the Step S16, the MPU 20 compares the remaining recording time Tr with the predetermined reference remaining recording time TrR to determine whether or not the remaining recording time Tr is less than the reference remaining time TrR (i.e., whether or not the remaining recording time Tr<reference remaining recording time TrR) (Step S18). In this process, it is preferred for the reference recording time TrR to adopt the time length ranging from the point at which the pickup roller 6 starts to rotate to the point at which the sheet P2 for the next page starts to be transferred, since such time length is substantially equivalent to the pre-excitement time of the feed sheet motor ASFM 28 which drives the pickup roller 6. The MPU 20 repeats the processes in the Step S16 and the Step S18 until it is found, in the Step 18, that the remaining recording time Tr is less than the reference remaining recording time TrR.

Upon finding, in the Step 18, that the remaining recording time Tr is less than the reference remaining recording time TrR, the MPU 20 issues the commanding signal for permitting the feed sheet unit 4 to start the supply of the sheet P2 for the next page. By so doing, the carriage (the recording head 2) is made to travel from the position 2*p* to the position 2*e* so that the sheet P2 for the next page can be sent out from the feed sheet unit 4 after the passage of the remaining recording time Tr for the completion of the recording. Subsequently, the MPU 20 repeats the determination processing in the step S10 and also repeats processes of the steps S12 through S20 until it is found that the data for the recording on the next page is not present.

Further, it seems to have been known to the person skilled in the art that the sheet P1, which has been transferred to the position 2*e* to complete the recording thereon, is ejected after being transferred at a speed higher than the normal speed, while the supplied sheet P2 for the next page is transferred to the front-finding point before a first transfer roller 9 from the feed sheet tray.

As discussed in the foregoing, in the ink jet recording apparatus 1, while the recording of the image on the sheet P1 for the present page is in progress, not only the remaining length-to-rear end Le ranging from the point at which the present sheet is detected by the sheet detection sensor S3 to the rear end Pe of the sheet P1 for the present page is measured but also the remaining recording time Tr ranging from the present point to the point at which the formation of the image on the sheet P1 for the present page will be completed is measured. Further, in the ink jet recording apparatus 1, in forming the image on the sheet P2 for the next page, the feed of the sheet P2 for the next page from the feed sheet unit 4 is started when it is confirmed that the remaining length-to-rear end Le is less than the reference remaining length-to-rear end Lr, and that the remaining recording time Tr is less than the reference remaining recording time TrR. In other words, the timing for starting the feed of the sheet can be set to earlier not only by assuring to prevent the overlapping of the sheet P1 for the present page and the sheet P2 for the next page by the processing in the step S14 but also by feeding the sheet almost simultaneously with the processing for printing before the processing for ejection of the sheet by the processing in the step S18.

By doing so, it can be made possible to issue the command for starting the feed of the sheet P2 for the next page while the formation of the image on the sheet P1 for the present page is in progress, without inviting the overlapping of the sheet P1 for the present page and the sheet P2 for the next page. Thus, with the ink jet recording apparatus 1, the time for starting the feed of the sheet P2 for the next page, whereon the image is to be formed of the sheet P2, can be set properly and earlier, whereby the throughput can be improved with ease.

Up to this point, the present invention has been described assuming that the series of processes shown in the flowchart of FIG. 3 take place on the side of the ink jet recording apparatus 1, but the processes of the present invention are not limited thereto. All or the part of the series of the processes given in the flowchart of FIG. 3 can also be executed by the printer driver 32 on the side of the host computer 31.

Further, needless to say, the object of the present invention can also be accomplished where the storage medium storing the program codes of the software designed for realizing the functions of the previously described embodiment is provided for the system or the apparatus so that the program code stored in the storage medium is read out for being executed by the computer (or the CPU or MPU) incorporated into such system or the apparatus. In such a case, the program code itself, when read out from the storage medium, is used for realizing the function of the previously described embodiment, so that the storage medium storing the program code and the program code itself are included in the scope of the present invention.

When applying the present invention to the above-mentioned storage medium, the program code corresponding to the flowchart shown in FIG. 3 is stored in such storage medium. In such a case, the program characteristic of the present invention is the program code corresponding to the steps S12 through S20 of the flowchart shown in FIG. 3. Thus, it is obvious that the program code itself having said characteristic or the storage medium storing such program code is included in the scope of the present invention.

Further, the storage media for providing the program codes may be, for example, the floppy® disks, hard disks, optical disks, magneto-optical disks, CD, ROM, CD-R, DVD, DVD-RAM, magnetic tape, non-volatile memory card, ROM or the like.

Further, it is obvious that not only the embodiment of the present invention whose function can be realized according to the program code accessed by the computer but also the embodiment of the present invention whose function can be realized according to the program code to be executed either totally or partially by means of the OS (Operating System) for operating the computer are included in the scope of the present invention.

Further, it is also obvious that the embodiment of the present invention, which is to be realized either totally or partially according to the program codes, which are stored in the memory of the function extension board incorporated into the computer or the function extension unit connected with the computer, is also included in the scope of the present invention.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet recording apparatus for forming an image on a recording medium supplied from a feed sheet unit and transferred in a predetermined transfer direction by jetting ink from a recording head made to move in the main scanning direction thereof, the apparatus comprising:

a recording medium detection unit for detecting a first recording medium whereon formation of an image is in progress, provided on an upstream side of the recording head in the transfer direction;

a remaining length-to-rear end measuring unit for measuring length from a point at which presence of said first recording medium is detected by said recording medium detection unit to a rear end of said first recording medium;

a remaining recording time measuring unit for measuring time from said point until the formation of the image on said first recording medium is completed; and a control unit for letting said feed sheet unit start a feed of a second recording medium when the length measured by said remaining length-to-rear end measuring unit is found to be less than predetermined reference length, and the time measured by said remaining recording time measuring unit is found to be less than predetermined reference time, said predetermined reference time is time from a point at which a feed of a sheet is started by said feed sheet unit until said second recording medium starts to move.

2. An ink jet recording apparatus according to claim 1, further comprising a next page recording determining unit for determining whether formation of an image on said second recording medium is necessary or not when said second recording medium for the next page is supplied from said feed sheet unit following said first recording medium, wherein said control unit operates for letting the feed of said second recording medium start when it is found that the image needs to be formed on said second recording medium by said next page recoding determining unit.

3. An ink jet recording method for forming an image on a recording medium supplied from a feed sheet unit and transferred in a predetermined transfer direction by jetting ink from a recording head made to move in the main scanning direction thereof, the method comprising the steps of:

(a) detecting a first recording medium whereon formation of an image is in progress on an upstream side of the recording head in the transfer direction;

(b) measuring length from a point at which presence of said first recording medium is detected in the step (a) to a rear end of said first recording medium;

(c) measuring time from said point until the formation of the image on said first recording medium is completed; and (d) letting said feed sheet unit start a feed of the second recording medium when the length measured in the step (b) is found to be less than predetermined reference length, and the time measured in the step (c) is found to be less than predetermined reference time, said predetermined reference time is time from a point at which a feed of a sheet is started by said feed sheet unit until said second recording medium starts to move.

4. An ink jet recording method according claim 3, wherein the step (d) comprises determining whether or not an image needs to be formed on said second recording medium for the next page to be supplied from said feed sheet unit following said first recording medium so that the feed of said second recording medium can be started when it is found that the image needs to be formed on said second recording medium.

5. A computer program product for executing an ink jet recording method for forming an image on a recording medium supplied from a feed sheet unit and transferred in a predetermined transfer direction by jetting ink from a recording head made to move in the main scanning direction thereof, said computer program product comprising:

(a) first program code means for detecting a first recording medium whereon formation of an image is in progress on an upstream side of the recording head in the transfer direction;

(b) second program code means for measuring length from a point at which presence of said first recording medium is detected in the step (a) to a rear end of said first recording medium;

(c) third program code means for measuring time from said point until the formation of the image on said first recording medium is completed; and (d) fourth program code means for letting said feed sheet unit start a feed of the second recording medium when the length measured in said second program code means (b) is found to be less than predetermined reference length, and the time measured in said third program code means (c) is found to be less than predetermined reference time, said predetermined reference time is time from a point at which a feed of a sheet is started by said feed sheet unit until said second recording medium starts to move.

6. An computer program product according to claim 5, wherein said fourth program code means (d) comprises determining whether or not an image needs to be formed on said second recording medium for the next page to be supplied from said feed sheet unit following said first recording medium so that the feed of said second recording medium can be started when it is found that the image needs to be formed on said second recording medium.

* * * * *